US011445791B1

(12) United States Patent
Jones

(10) Patent No.: US 11,445,791 B1
(45) Date of Patent: Sep. 20, 2022

(54) ELASTOMERIC MONEY OR WALLET BAND

(71) Applicant: Anthony Jones, New Brunswick, NJ (US)

(72) Inventor: Anthony Jones, New Brunswick, NJ (US)

( * ) Notice: Subject to any disclaimer, the term of this patent is extended or adjusted under 35 U.S.C. 154(b) by 524 days.

(21) Appl. No.: 16/565,671

(22) Filed: Sep. 10, 2019

(51) Int. Cl.
*A45C 1/06* (2006.01)
*A45C 11/18* (2006.01)

(52) U.S. Cl.
CPC ..... *A45C 1/06* (2013.01); *A45C 11/182* (2013.01)

(58) Field of Classification Search
CPC ..... A45C 11/182; A45C 13/30; A45C 2013/1061
USPC ..... 150/132; D11/78; 24/178
See application file for complete search history.

(56) References Cited

U.S. PATENT DOCUMENTS 5,279,019 A 1/1994 Knickle
6,205,622 B1 3/2001 Odishoo
6,230,878 B1 * 5/2001 Lehr ..... A45C 11/182 206/37
6,357,084 B1 * 3/2002 Haidon ..... A45C 1/00 24/3.12
7,305,996 B2 * 12/2007 Kraft ..... A45D 8/34 132/273
7,748,086 B2 * 7/2010 Bridgefarmer ..... A45C 11/182 150/132
8,381,360 B2 2/2013 Preston-Hall
D740,155 S 10/2015 Vang
10,582,748 B1 * 3/2020 Finley ..... A45C 13/02
2002/0194711 A1 12/2002 Stampler
2004/0103500 A1 * 6/2004 Ward ..... B65D 63/109 24/17 B
2004/0172789 A1 * 9/2004 Lehr ..... B65D 63/109 24/17 AP
2007/0095870 A1 * 5/2007 Griffith ..... A45C 13/30 24/3.2
2009/0007396 A1 1/2009 Glickfield
2009/0211062 A1 * 8/2009 Preston-Hall ..... A45C 1/08 24/17 B
2010/0205783 A1 8/2010 Bridgefarmer
2019/0328064 A1 * 10/2019 Lee ..... A41D 20/00
2020/0000190 A1 * 1/2020 Grafilo ..... A45C 11/182

* cited by examiner

*Primary Examiner* — Sue A Weaver
(74) *Attorney, Agent, or Firm* — Kyle A. Fletcher, Esq.

(57) ABSTRACT

The elastomeric money or wallet band is a fastening structure. The elastomeric money or wallet band comprises an elastic band and one or more negotiable instruments. The elastomeric money or wallet band is configured for use with the one or more negotiable instruments. The elastomeric money or wallet band binds the one or more negotiable instruments together.

14 Claims, 4 Drawing Sheets

ELASTOMERIC MONEY OR WALLET BAND

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of travelling articles including purses, luggage, and hand carried bags, more specifically, a ticket holder or the like. (A45C11/18)

SUMMARY OF INVENTION

The elastomeric money or wallet band is a fastening structure. The elastomeric money or wallet band comprises an elastic band and one or more negotiable instruments. The elastomeric money or wallet band is configured for use with the one or more negotiable instruments. The elastomeric money or wallet band binds the one or more negotiable instruments together.

These together with additional objects, features and advantages of the elastomeric money or wallet band will be readily apparent to those of ordinary skill in the art upon reading the following detailed description of the presently preferred, but nonetheless illustrative, embodiments when taken in conjunction with the accompanying drawings.

In this respect, before explaining the current embodiments of the elastomeric money or wallet band in detail, it is to be understood that the elastomeric money or wallet band is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the elastomeric money or wallet band.

It is therefore important that the claims be regarded as including such equivalent construction insofar as they do not depart from the spirit and scope of the elastomeric money or wallet band. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
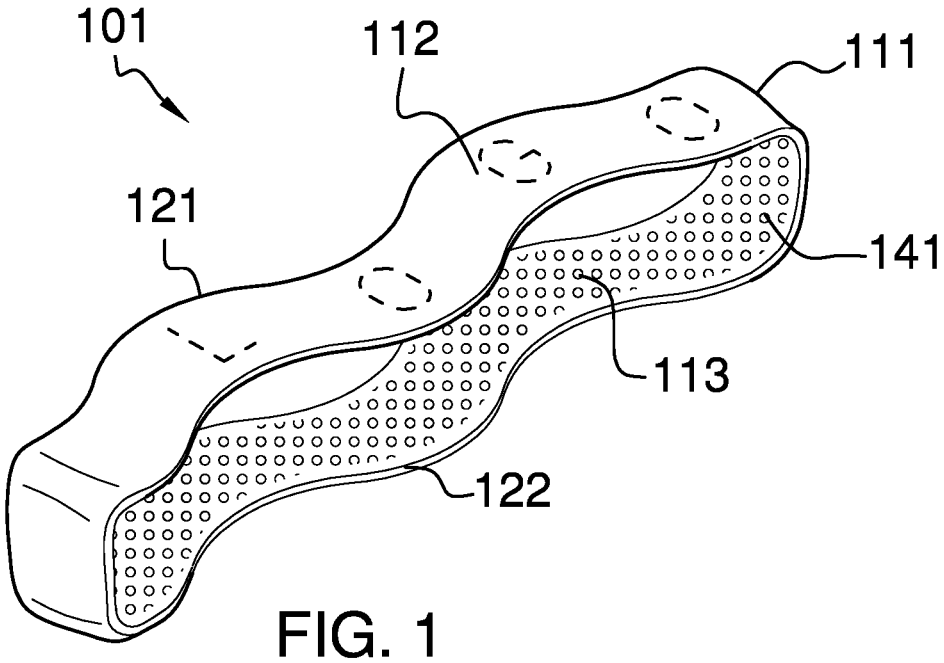
FIG. 1 is a perspective view of an embodiment of the disclosure.
Figure 2:
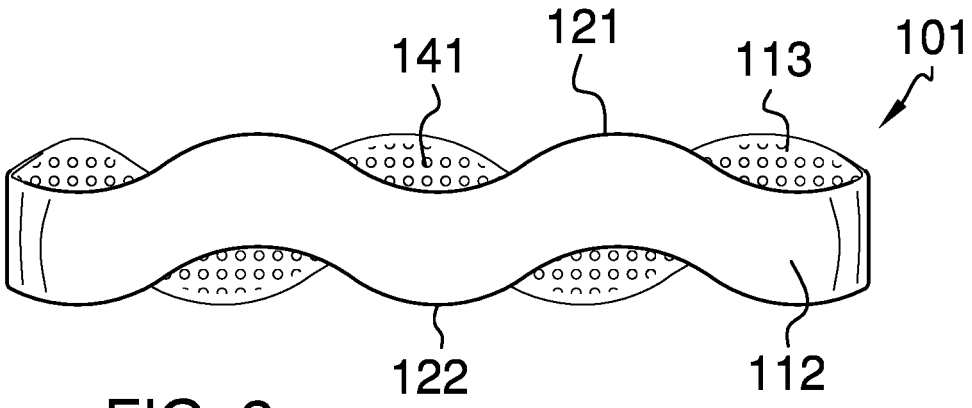
FIG. 2 is a side view of an embodiment of the disclosure.
Figure 3:
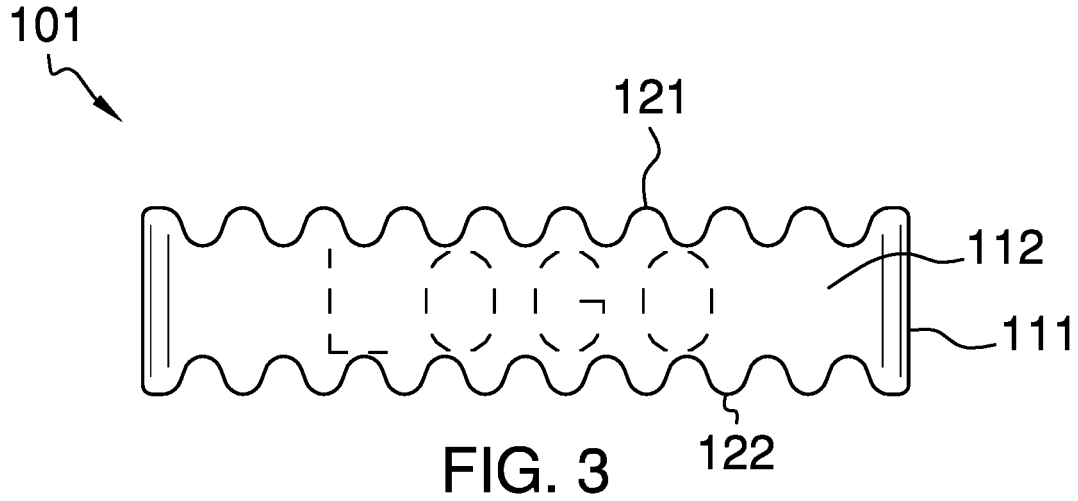
FIG. 3 is a side view of an alternate embodiment of the disclosure.
Figure 4:
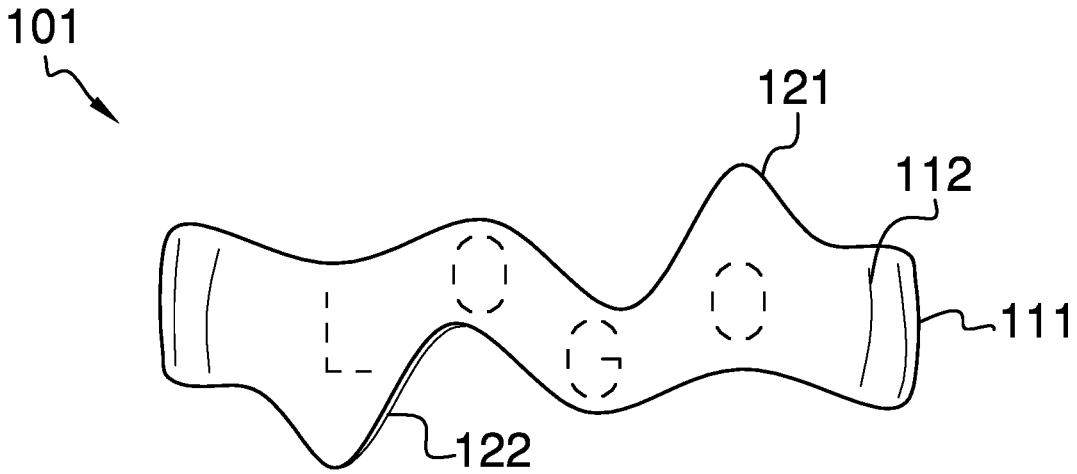
FIG. 4 is a side view of an alternate embodiment of the disclosure.
Figure 5:
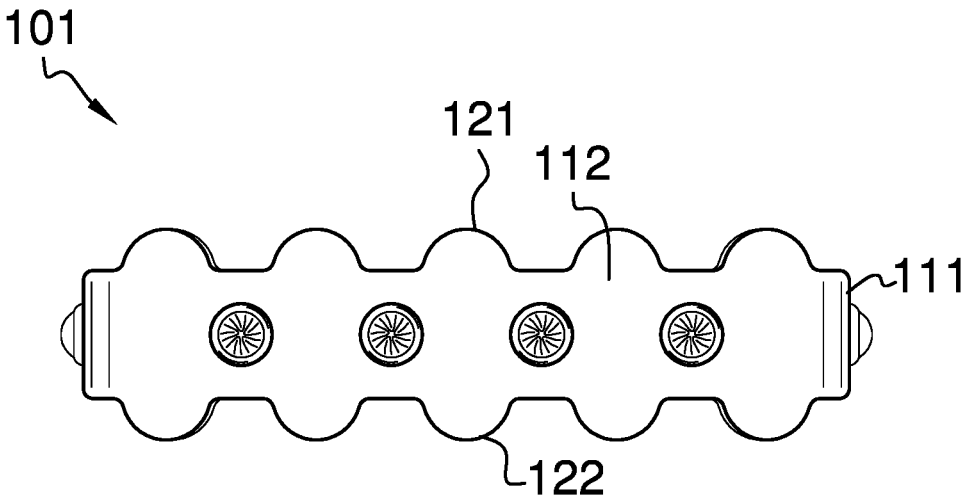
FIG. 5 is a side view of an alternate embodiment of the disclosure.
Figure 6:
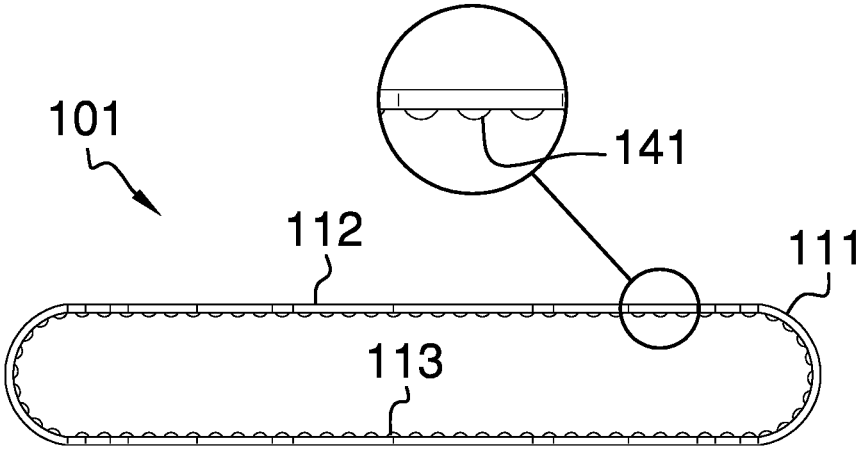
FIG. 6 is a top view of an alternate embodiment of the disclosure.
Figure 7:
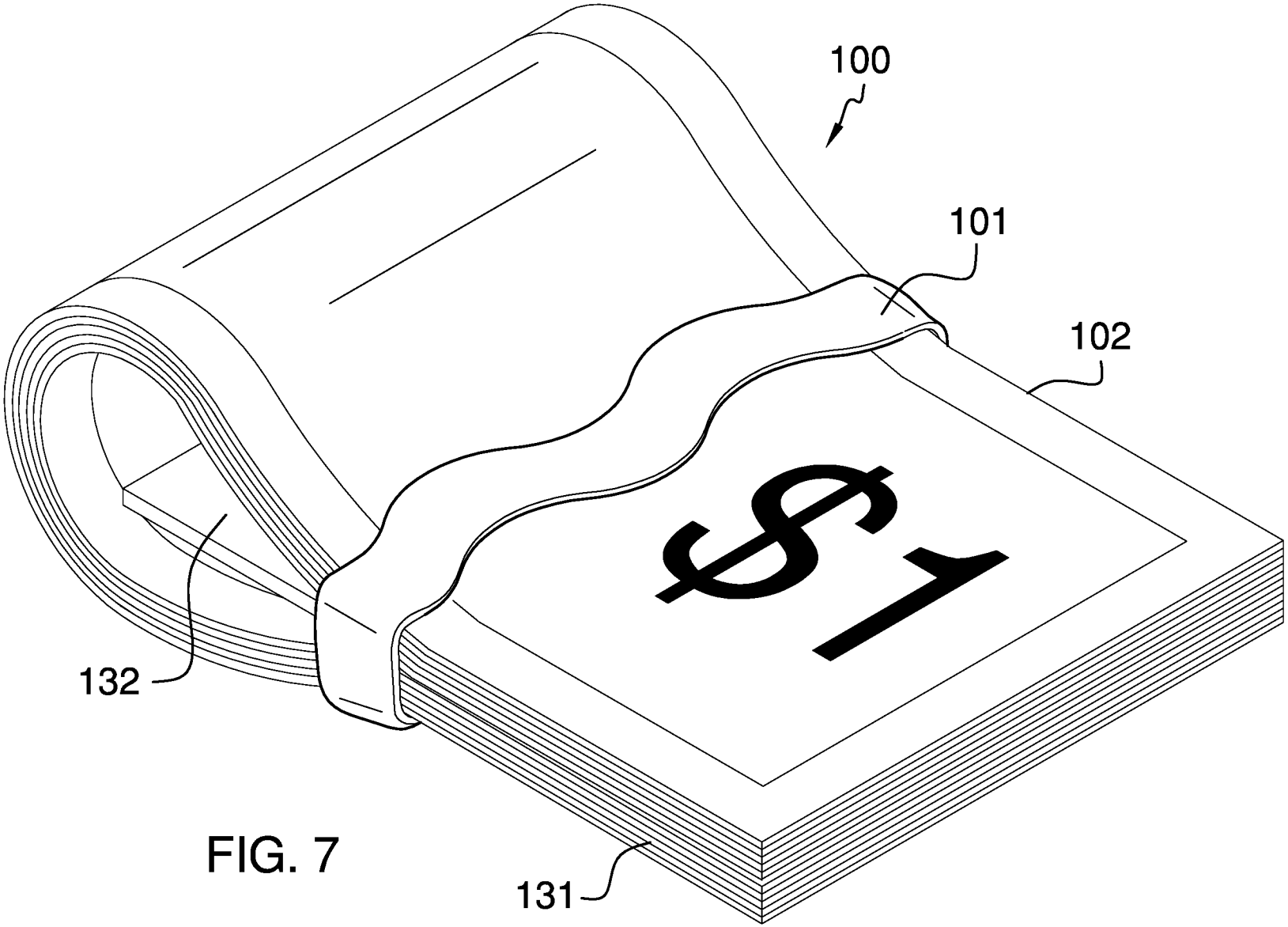
FIG. 7 is an in-use view of an embodiment of the disclosure.

Detailed reference will now be made to one or more potential embodiments of the disclosure, which are illustrated in FIGS. 1 through 7.

The elastomeric money or wallet band 100 (hereinafter invention) is a fastening structure. The invention 100 comprises an elastic band 101 and one or more negotiable instruments 102. The invention 100 is configured for use with the one or more negotiable instruments 102. The invention 100 binds the one or more negotiable instruments 102 together.

Each of the one or more negotiable instruments 102 is an object used to facilitate a financial transaction. Each of the one or more negotiable instruments 102 is selected from the group consisting of: a) one or more banknotes issued as part of a currency 131; and, b) one or more credit cards 132. The elastic band 101 binds the one or more negotiable instruments 102 such that the one or more negotiable instruments 102 remain bound as a single package during the transport of the one or more negotiable instruments 102. The one or more negotiable instruments 102 comprises currency 131 and one or more credit cards 132. The currency 131 is defined elsewhere in this disclosure. The credit card 132 is defined elsewhere in this disclosure.

The elastic band 101 is an elastic structure. The elastic band 101 has a loop shape. The elastic band 101 binds the one or more negotiable instruments 102 together. The elastic band wraps around the one or more negotiable instruments 102 to bind the one or more negotiable instruments 102 together.

The elastic band 101 acts as a spring. Specifically, when the one or more negotiable instruments 102 insert into the elastic band 101 is deformed such that the one or more negotiable instruments 102 fits through the center loop of the elastic band 101 The elasticity of the elastic band 101 creates a force that opposes the deformation required for the insertion of the one or more negotiable instruments 102 into the elastic band 101. This opposing force is in a direction that returns the elastic band 101 to its relaxed shape. Because the one or more negotiable instruments 102 prevents the elastic band 101 from returning completely to its relaxed shape, the elastic band 101 applies a force against the one or more negotiable instruments 102 that binds the one or more negotiable instruments 102 together.

The polyurethane structure of the loop structure 111 acts as a spring. Specifically, when the one or more negotiable instruments 102 insert into the loop structure 111 is deformed such that the one or more negotiable instruments 102 fits through the center loop of the loop structure 111 The elasticity of the loop structure 111 creates a force that opposes the deformation required for the insertion of the one or more negotiable instruments 102 into the loop structure 111. This opposing force is in a direction that returns the loop structure 111 to its relaxed shape. Because the one or more negotiable instruments 102 prevents the loop structure 111 from returning completely to its relaxed shape, the loop structure 111 applies a force against the one or more negotiable instruments 102 that binds the one or more negotiable instruments 102 together.

The elastic band 101 comprises a first undulating edge 121, a second undulating edge 122, a loop structure 111, an exterior surface 112, and an interior surface 113.

The first undulating edge 121 is a structure formed in a lateral face of the disk structure of the loop structure 111. The first undulating edge 121 runs roughly parallel to the major axes of both the exterior surface 112 and the interior surface 113. The second undulating edge 122 is a structure formed in a lateral face of the disk structure of the loop structure 111. The second undulating edge 122 runs roughly parallel to the major axes of both the exterior surface 112 and the interior surface 113. The first undulating edge 121 and the second undulating edge 122 provide a characteristic appearance of the invention 100.

The loop structure 111 is a disk-shaped strip structure. Two lateral faces of the disk shape of the strip attach to themselves such that the strip structure of the loop structure forms a loop with a non-Euclidean disk shape. The loop structure 111 is formed from an elastomeric material. Specifically, the loop structure 111 is formed from an elastomeric material formed from polyurethane. The loop structure 111 is sized such that the one or more negotiable instruments 102 inserts through the loop formed by the loop structure 111.

The exterior surface 112 is a congruent end of the non-Euclidean disk-shaped strip that forms the loop structure 111. The exterior surface 112 forms the surface of the loop structure that is distal from the one or more negotiable instruments 102 that are bound by the loop structure 111.

The interior surface 113 is a congruent end of the non-Euclidean disk-shaped strip that forms the loop structure 111. The interior surface 113 forms the surface of the loop structure 111 that is proximal to the one or more negotiable instruments 102 that are bound by the loop structure 111. The interior surface 113 is the face of the loop structure 111 that is distal from the exterior surface 112.

The interior surface 113 is formed with a pebbled structure 141. The pebbled structure 141 comprises a granulated elastomeric structure that covers the interior surface 113 of the loop structure 111. The pebbled structure 141 presses into the one or more negotiable instruments 102 as they are bound by the loop structure 111 such that the one or more negotiable instruments 102 is more securely stored within the elastic band 101. In the first potential embodiment of the disclosure, the pebbled structure 141 is formed as a plurality of semispherical structures that are evenly distributed across the interior surface 113 of the loop structure 111. The pebbled structure 141 is formed simultaneously with the formation of the loop structure 111 of the elastic band 101.

Various instantiations of the invention 100 are differentiated by varying: a) the waveshape of the undulation of the first undulating edge 121; b) the waveshape of the undulation of the second undulating edge 122; c) the wavelength of the undulation of the first undulating edge 121; d) the wavelength of the undulation of the second undulating edge 122; and, e) the phase difference between the waveshapes of the first undulating edge 121 second undulating edge 122.

The following definitions were used in this disclosure:

Band: As used in this disclosure, a band is a flat loop of material.

Bind: As used in this disclosure, to bind is a verb that means to tie or secure a plurality of similar first objects together by wrapping a second object around the plurality of similar first objects.

Carbamate: As used in this disclosure, a carbamate is a functional group consisting of an O—(C═O)—N structure. Carbamate is informally referred to as urethane.

Copolymer: As used in this disclosure, a copolymer is a polymer formed from two or more repeating molecules (also referred to as monomers).

Credit Card: As used in this disclosure, a credit card is a form of identification that enables a person bearing the card to purchase a good or service from a vendor on the basis of credit provided by either the vendor or a third party. The form factor of a credit card is standardized with dimensions of roughly 3.4 inches by 2.1 inches.

Currency: As used in this disclosure, currency refers to banknotes and coins issued by an appropriate authority used to facilitate economic transactions.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Band: As used in this disclosure, an elastic band is a loop of textile that is formed using elastic material that can stretched. Alternatively, the elastic band can be a sheeting that is formed from latex, spandex, or an elastic or plastic film that can be stretched.

Exterior: As used in this disclosure, the exterior is used as a relational term that implies that an object is not contained within the boundary of a structure or a space.

Form Factor: As used in this disclosure, the term form factor refers to the size and shape of an object.

Frequency and Wavelength: As used in this disclosure, the terms frequency and wavelength refers to parameters used to describe a wave that transmits or transfers energy. The frequency measures the frequency of passage of a fixed point of the waveform of the wave. The wavelength describes the span of distance between the fixed points of the waveform of two sequential waves. The wavelength and frequency are related by the equation: wavelength× frequency=wave speed through the media. For many types of waves (such as sound and light), the speed of the wave through the media can be taken as a constant.

Granule: As used in this disclosure, refers to an individual particle selected from a plurality of particles that represents a material. A material formed from a plurality of granules is said to be a granular or granulated material. The verb granulate refers to the formation of granules to create a granular material. A granular material often exhibits fluidic behaviors including flow.

Granulated Surface: As used in this disclosure, a granulated surface refers to a surface of an object formed from granules. A pebbled surface is a granulated surface.

Interior: As used in this disclosure, the interior is used as a relational term that implies that an object is contained within the boundary of a structure or a space.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Major and Minor Axes: As used in this disclosure, the major and minor axes refer to a pair of perpendicular axes that are defined within a structure. The length of the major axis is always greater than or equal to the length of the minor axis. The major axis is always the longest diameter of the structure. The major and minor axes intersect at the center of the structure. The major axis is always parallel to the longest edge of a rectangular structure.

Monomer: As used in this disclosure, a monomer refers to a molecular structure that bonds to itself in a repeating manner to form a polymer.

Negotiable Instruments: As used in this disclosure, negotiable instruments are objects used to facilitate financial transactions. In this disclosure, negotiable instruments are one or more items selected from the group consisting of: a) currency; and, b) credit cards.

Non-Euclidean Disk: As used in this disclosure, a non-Euclidean structure is a disk-shaped structure wherein the congruent end (faces) of the disk structure lies on a non-Euclidean plane.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

Phase: As used in this disclosure, the term phase refers to an offset between two identical waveforms that are transferring energy. The offset, which can roughly be thought of as a delay, between the two identical waveforms is measured as an angular difference. The offset measured by the phase allows identical waveforms to cancel each other out.

Polymer: As used in this disclosure, a polymer refers to a molecular chain that comprises multiple repeating units known as monomers. The repeating unit may be an atom or a molecular structure.

Polyurethane: As used in this disclosure, a polyurethane is a copolymer wherein the one or more monomer chains are linked together carbamates.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Relaxed Shape: As used in this disclosure, a structure is considered to be in its relaxed state when no shear, strain, or torsional forces are being applied to the structure.

Roughly: As used in this disclosure, roughly refers to a comparison between two objects. Roughly means that the difference between one or more parameters of the two compared objects are not significantly different.

Strip: As used in this disclosure, the term describes a long and narrow object of uniform thickness that appears thin relative to the length of the object.

Texture: As used in this disclosure, a texture is a tactile or three-dimensional characteristic of a surface. In daily use, texture will on occasion refer to a visual characteristic of the surface.

Undulating: As used in this disclosure, undulating refers to an object or medium that: a) has a wave transferring energy through the object or medium; or, b) has a shape that gives the appearance that a wave is transferring energy through the object or medium.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An elastomeric money band comprising an elastic band and a wallet or one or more negotiable instruments;

wherein the elastomeric money band is a fastening structure;

wherein the elastomeric money band binds the wallet or one or more negotiable instruments together;

wherein the elastic band binds the wallet or the one or more negotiable instruments such that the wallet or one or more negotiable instruments remain bound as a single package during the transport of the one or more negotiable instruments;

wherein each of the one or more negotiable instruments is an object used to facilitate a financial transaction;

wherein each of the one or more negotiable instruments is selected from the group consisting of: a) one or more banknotes issued as part of a currency; and, b) one or more credit cards;

wherein the elastic band is an elastic structure;

wherein the elastic band has a loop shape;

wherein the elastic band wraps around the one or more negotiable instruments to bind the one or more negotiable instruments together;

wherein the elastic band comprises a first undulating edge, a second undulating edge, a loop structure, an exterior surface, and an interior surface;

wherein the first undulating edge is a structure formed in a lateral face of the loop structure;

wherein the second undulating edge is a structure formed in a lateral face of the loop structure;

wherein the exterior surface is a congruent end of the loop structure;

wherein the interior surface is a congruent end of the loop structure;

wherein the interior surface is the face of the loop structure that is distal from the exterior surface.

2. The elastomeric money band according to claim 1 wherein the first undulating edge runs roughly parallel to the major axes of both the exterior surface and the interior surface;

wherein the second undulating edge runs roughly parallel to the major axes of both the exterior surface and the interior surface.

3. The elastomeric money band according to claim 2 wherein the loop structure is sized such that the one or more negotiable instruments insert through the loop formed by the loop structure.

4. The elastomeric money band according to claim 3 wherein the loop structure is formed from an elastomeric material.

5. The elastomeric money band according to claim 4 wherein the loop structure applies a force against the one or more negotiable instruments that binds the one or more negotiable instruments together.

6. The elastomeric money band according to claim 5 wherein the loop structure is formed from an elastomeric material formed from polyurethane.

7. The elastomeric money band according to claim 6 wherein the exterior surface forms the surface of the loop structure that is distal from the one or more negotiable instruments that are bound by the loop structure.

8. The elastomeric money band according to claim 7 wherein the interior surface forms the surface of the loop structure that is proximal to the one or more negotiable instruments that are bound by the loop structure.

9. The elastomeric money band according to claim 8 wherein the interior surface is formed with a pebbled structure.

10. The elastomeric money band according to claim 9 wherein the pebbled structure presses into the one or more negotiable instruments as they are bound by the loop structure such that the one or more negotiable instruments.

11. The elastomeric money band according to claim 10 wherein the pebbled structure comprises a granulated elastomeric structure that covers the interior surface of the loop structure.

12. The elastomeric money band according to claim 11 the pebbled structure is formed as a plurality of semispherical structures that are evenly distributed across the interior surface of the loop structure.

13. The elastomeric money band according to claim 12 wherein the pebbled structure is formed simultaneously with the formation of the loop structure of the elastic band.

14. The elastomeric money band according to claim 13 wherein various instantiations of the elastomeric money band are differentiated by varying: a) the waveshape of the undulation of the first undulating edge; b) the waveshape of the undulation of the second undulating edge; c) the wavelength of the undulation of the first undulating edge; d) the wavelength of the undulation of the second undulating edge; and, e) the phase difference between the waveshapes of the first undulating edge and the second undulating edge.

* * * * *